United States Patent [19]

Matsuno et al.

[11] 4,100,872

[45] Jul. 18, 1978

[54] SLURRY VESSEL

[75] Inventors: Yoshiyuki Matsuno, Nagasaki; Hiroshi Kobayashi; Ryo Watanabe, both of Kobe, all of Japan

[73] Assignee: Mitsubishi Jukogyo Kabushiki Kaisha, Tokyo, Japan

[21] Appl. No.: 822,360

[22] Filed: Aug. 5, 1977

Related U.S. Application Data

[63] Continuation-in-part of Ser. No. 580,472, May 22, 1975, abandoned.

[30] Foreign Application Priority Data

May 22, 1974 [JP] Japan ..... 49/57483

[51] Int. Cl.[2] ..... B63B 25/04

[52] U.S. Cl. ..... 114/73; 210/86; 210/112; 210/242 R; 214/14

[58] Field of Search ..... 114/73, 74 R, 72; 210/20, 86, 112, 242, 513; 214/12–14, 15 B; 73/290, 306, 309

[56] References Cited

U.S. PATENT DOCUMENTS

| | | | |
|---|---|---|---|
| 56,702 | 7/1866 | Campbell | 73/306 |
| 1,150,981 | 8/1915 | Walter | 214/15 B |
| 1,160,465 | 11/1915 | Thomas | 73/306 |
| 1,344,663 | 6/1920 | Waldrop | 73/306 |
| 1,472,317 | 10/1923 | Allen | 210/112 |
| 1,770,308 | 7/1930 | Herring | 210/86 |
| 2,850,439 | 9/1958 | Bodkin | 210/20 |
| 3,578,171 | 5/1971 | Usher | 210/513 |
| 3,810,547 | 5/1974 | Shudo | 214/14 |
| 3,812,984 | 5/1974 | Cladingboez | 214/15 B |

*Primary Examiner*—Trygve M. Blix
*Assistant Examiner*—Stuart M. Goldstein
*Attorney, Agent, or Firm*—Cushman, Darby & Cushman

[57] ABSTRACT

A vessel provided with a hold for transporting a cargo of slurry, such as pulverized iron ore and water, is provided with vacuum dewatering means and a device for monitoring the progress of consolidation of the solid particles. When vibration or other motion of the vessel tends to increase the rate of consolidation, the vacuum dewatering means is operated to lower the rate, so that when the vessel reaches its destination, the cargo may be more easily unloaded. A particular design of slurry/-supernatant liquid interface level detector is described.

2 Claims, 5 Drawing Figures

SLURRY VESSEL

REFERENCE TO RELATED APPLICATION

This is a continuation-in-part of our earlier copending U.S. Pat. application, Ser. No. 580,472; filed May 22, 1975 and now abandoned in favor hereof.

FIELD OF THE INVENTION

This invention relates to a vessel for transporting slurry, and to means for retarding consolidation of the slurry during transport thereof.

BACKGROUND OF THE INVENTION

Prior art slurry vessels have suffered from problems such that the slurry loaded therein undergoes consolidation due to the dynamic effects resulting from movement of the hull during the cruise, resulting in a marked lowering in the efficiency of unloading.

To alleviate consolidation of the slurry, various measures have heretofore been taken, such as the addition of a surface active agent as an anti-consolidation composition into the slurry, the application of forced stirring to the slurry by means of a stirrer, and the like. However, these measures are not wholly satisfactory.

SUMMARY OF THE INVENTION

The present invention overcomes the above-mentioned disadvantages of the prior art and has its object to provide a slurry vessel which can effectively retard and reduce consolidation of slurry and which is provided with means for suitably monitoring and controlling the degree of consolidation of slurry, thereby increasing the efficiency of unloading work.

Accordingly, the slurry vessel in accordance with the present invention is characterized by comprising a plurality of dewatering ports arranged on a hold for slurry-like cargoes, a vacuum tank connected to each of said dewatering ports through a pipe line, and a dewatering means including a vacuum pump connected to the upper portion of said vacuum tank through a pipe line and a drain pump connected to the lower portion of said vacuum tank through a pipe line.

The slurry vessel in accordance with the present invention is further characterized by the provision of means for detecting a precipitation level of a layer of slurry with said hold.

The principles of the invention will be further discussed with reference to the drawing wherein a preferred embodiment is shown. The specifics illustrated in the drawing are intended to exemplify, rather than limit, aspects of the invention as defined in the claims.

IN THE DRAWING

DETAILED DESCRIPTION

Figure 1:
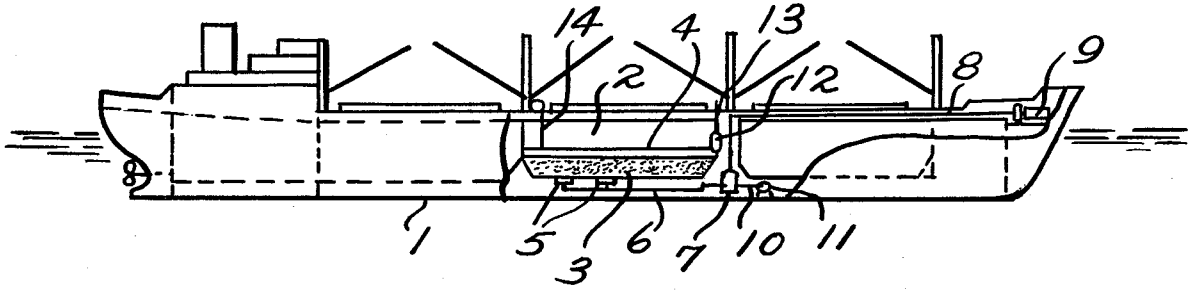
FIG. 1 is a cutaway side view illustrating principal parts of the slurry vessel in accordance with the present invention.
Figure 2:
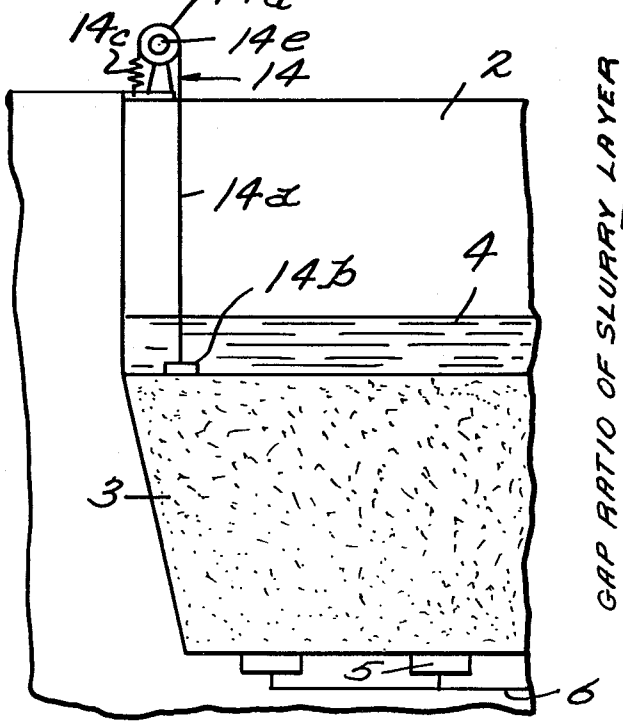
FIG. 2 is a side view illustrating a preferred form of the means for detecting the precipitation level of a layer of slurry.

Referring now to FIGS. 1 and 2, a hold 2 disposed within the slurry vessel 1 contains a slurry-like cargo 3 and supernatant water 4 produced as the slurry-like cargo 3 precipitates. A plurality of dewatering ports 5 are arranged in the bottom and side walls of the hold 2. A pipe line 6 is shown having one end connected to the dewatering port 5. A vacuum tank 7 is connected to the end of the pipe line 6. A pipe line 8 is shown having one end connected to the top of the vacuum tank 7. A vacuum pump 9 is connected to the other end of the pipe line 8. A pipe line 10 is shown having one end connected to the lower part of the vacuum tank 7. A drain pump 11 is connected to the other end of the pipe line 10. A drain pump 12 is provided for discharging the supernatant water 4. A pipe line 13 is connected to an outlet of the drain pump 12.

Means 14 are disposed in the hull and adapted to detect a precipitation level of a layer of slurry within the hold. Referring to FIG. 2 the reference character **14*a* designates an inextensible, flexible cord attached to the hull through a spring 14*c*. The cord has one end provided with a weight 14*b* and the other end is passed over a wheel 14*d*. A shaft 14*e* journals the wheel for rotating the wheel 14*d***.

The weight **14*b* must be selected so that it is heavier than the supernatant water 4 but does not sink into the layer of slurry 3**. For instance the layer of slurry subjected to measurement at the time when decrease in thickness of layer comes into question may have specific gravity in excess of 2, appear to be half solid in nature and seem bereft of fluidity. In such an instance, the weight may be any form if the specific gravity $\gamma$ is $1<\gamma<2$. The shape thereof is better if rounded than if sharp.

Figure 4:
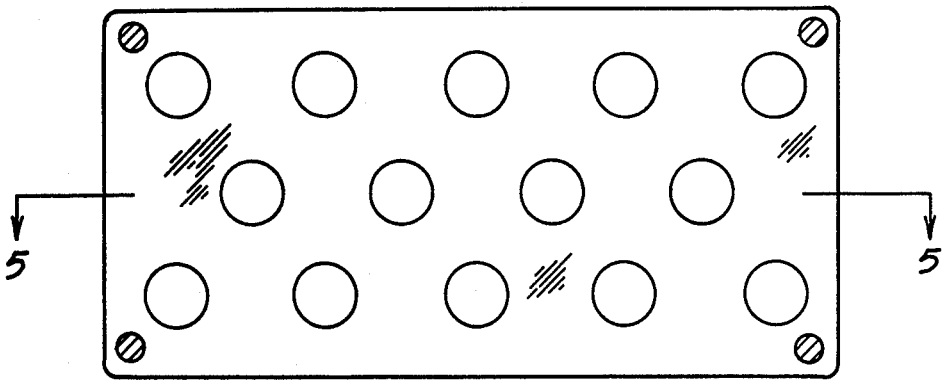
FIGS. 4 and 5 are, respectively, a top plan view and a longitudinal cross-sectional view of the perforated plate slurry detector supported for use.
Figure 5:
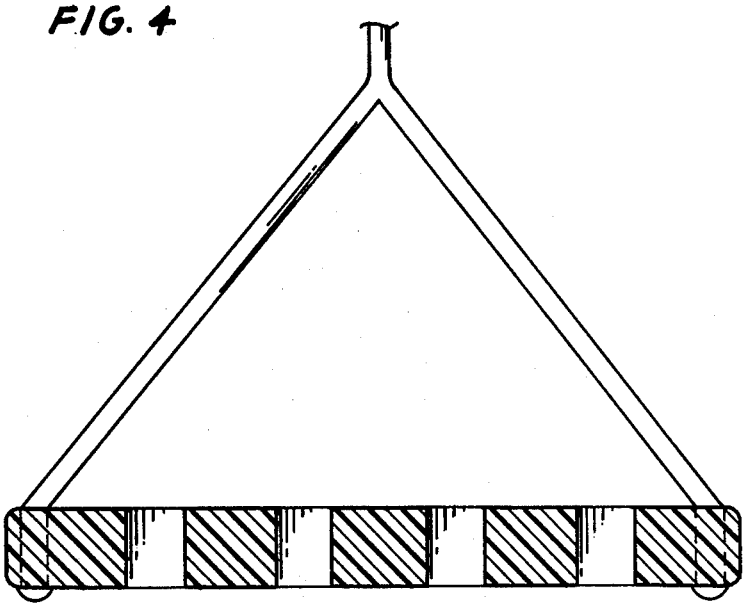

One example of a practical device suitable for detecting a supernatant liquid/settled slurry interfacial surface may be made by providing a plurality of openings perforated in flat plate made of a material whose specific gravity is larger than that of the liquid but smaller than that of the slurry (for example, made of vinyl chloride when the liquid is water and the slurry is of iron ore), and this flat plate is gradually lowered from the top surface of a tank as suspended by appropriate means from the top cradle-fashion as shown in FIGS. 4 and 5. In this case, the perforated plate sinks flatwise down through the liquid layer, but its movement is stopped at the top surface of the settled slurry, so that depending upon the position where the perforated plate has stopped, the position of the slurry layer surface can be detected.

A level detector suitable to be used for such object might be realized with a hollow container, but since the distance between the water surface and the slurry surface is normally not so large, it is necessary to use a relatively low container. On the other hand, the slurry surface detector of the present invention is made of a flat plate of synthetic resin whose specific gravity is somewhat larger than 1, and in this flat plate are perforated a plurality of small openings so that the plate may easily sink in the water while maintaining its horizontal attitude. This is because the vertical openings are adapted to allow free flow of supernatant liquid therethrough. When a thin flat plate is caused to sink in the water, there is a fear that upon contacting the slurry surface the flat plate may penetrate into the slurry layer unless it is maintained in a horizontal state, resulting in erroneous detection of the slurry surface. To form a float structure equivalent to this perforated flat plate by means of a hollow container, is not easy and is extremely expensive.

The slurry-like cargoes, after being loaded in the hold 2, are gradually precipitated and concentrated, separating into a highly concentrated layer of slurry 3 and supernatant water 4, and the supernatant water 4 is then discharged outside the vessel by means of the drain pump 12 passing through the pipe line 13. On the other hand, water in the highly concentrated layer of slurry 3 is vacuum-dewatered from the dewatering ports 5 in the hold bottom through the pipe line 6, vacuum tank 7, pipe line 8 and vacuum pump 9, while water remaining within the vacuum tank 7 is discharged outside the vessel through the pipe line 10 by means of the drain pump 11.

The surface of the slurry layer falls as consolidation proceeds, and the degree of such lowering may be detected by means for detecting the upper level of the layer of slurry. That is to say, the weight **14*b* moves downwardly with the progress of consolidation of the slurry layer, and accordingly, the distance of such downward movement may be determined by rotative displacement of the rotating shaft 14*e* in engagement with the wheel 14*d*. Under certain circumstances, such a degree may also be determined by measuring the force of spring 14*c***.

Further, since the rotative displacement of the rotating shaft **14*e* of the wheel 14*d* and the spring force of spring 14*c*** are capable of being automatically measured, variations in thickness of a layer of slurry may be easily determined automatically.

The operation of consolidation alleviation by way of vacuum-dewatering the slurry will now be described.

When water in the highly concentrated slurry is dewatered from the bottom of hold by the use of a vacuum-dewatering device, the following effects are produced.

(1) Increase in effective stress between solid particles.

If $\sigma_\epsilon$ is the effective stress between particles, equation may be written as $$\sigma_\epsilon = \sigma_\gamma - \sigma_\rho$$

where $\sigma_\gamma$ is the total pressure, and $\sigma_\rho$ is the pore water pressure. From this, it will be understood that when the pore water pressure $\sigma_\gamma$ is decreased by the operation of vacuum-dewatering, the effective stress $\sigma_\epsilon$ between particles increases so that the moving resistance of the solid particles increases, and as a result, re-arrangement or refilling of the particles becomes harder to produce and the progress of consolidation caused by the dense filling of particles is alleviated.

(2) Avoidance of occurrence of liquefaction phenomenon.

If there is unsaturation between solid particles, by the operation of vacuum-dewatering, the liquefaction pehnomenon is not exhibited, and as a result, the re-arrangement of solid particles is impaired, restraining the progress of consolidation.

(3) Increase in cohension between particles.

If there is unsaturation between particles, by the operation of vacuum-dewatering, apparent cohesion between particles caused by the capillary tension increases to increase the moving resistance of the particles, resulting in impairing the re-arrangement of solid particles.

Figure 3:
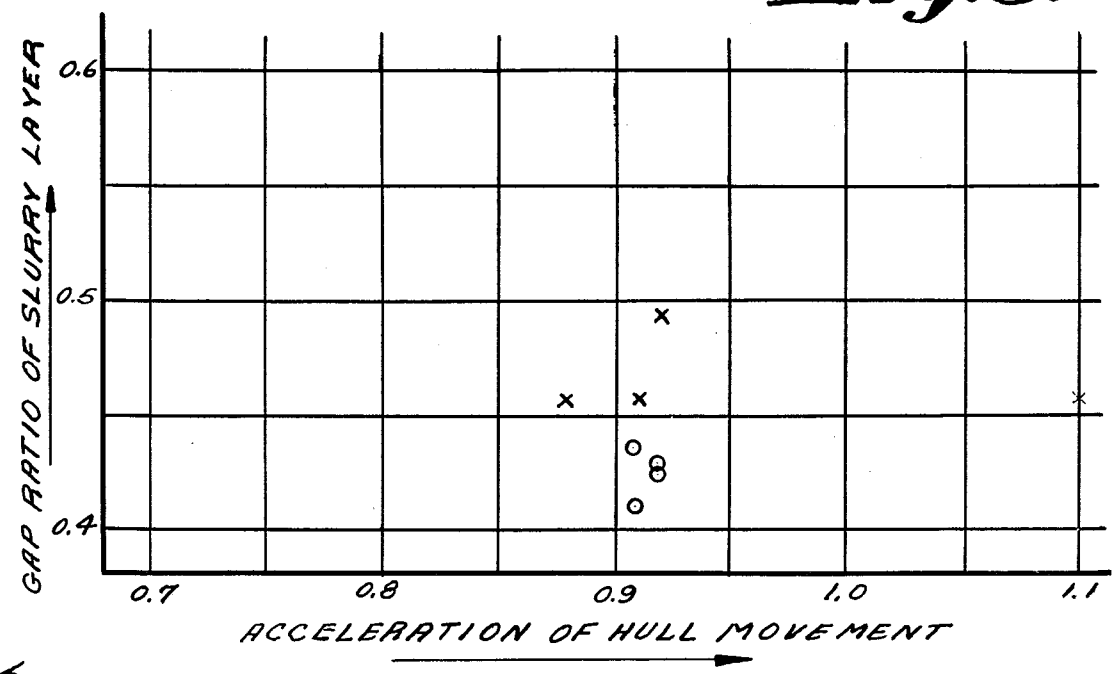
FIG. 3 is a graphic representation by way of experimental example indicating effect of alleviating consolidation of a layer of slurry obtained where the slurry-like cargoes are vacuum-dewatered.

One example of results obtained by tests of the use of the system of the invention is illustrated in FIG. 3. In FIG. 3, the acceleration of hull movement is represented by the axis of abscissa and the void ratio of the slurry layer is represented by the axis of ordinate. The void ratio $e$ is defined as $e = V_v/V_s$ where $V_v$ is the volume of the space in the layer of slurry, and $V_s$ is the volume of the solid particles in the layer of slurry. (The total volume of the slurry layer, $V_T$, equals $V_s + V_v$.) As is seen from this definition, when the consolidation of the slurry layer proceeds, the void ratio decreases, and when the consolidation does not proceed, the void ratio does not decrease. That is, in FIG. 3, the marks as indicated by $x$ and $o$ designate the void ratio of the slurry layer where the vacuum dewatering is taken place, and where the vacuum dewatering is not taken place, respectively. As is evident from the results, it will be understood that significant effects upon the rate of consolidation of the slurry layer may be achieved by vacuum dewatering. The rate consolidation generally poses no particular problem when the slurry vessel is anchored, but during the cruise the consolidation of slurry cargoes tends to proceed at an increased rate due to the dynamic effects caused by the hull movement and hull vibration, and hence, in this case, the above-mentioned means for alleviating consolidation is particularly necessary.

In consolidation control of slurry, the action of alleviating consolidation through vacuum dewatering may be utilized, by which operation the degree of consolidation of the slurry within the hold can be controlled to a suitable value.

Since it may be considered that consolidation of the slurry within the hold is produced due to the dynamic effects principally caused by the hull movement, it is not so necessary to continue operation of alleviating consolidation in the event weather conditions are calm and the dynamic effects of the hull movement are small, during the cruise.

Therefore, if the void ratio of the slurry layer can suitably be detected during the cruise, the drive of the vacuum dewatering device may be controlled according to the void ratio to bring the degree of consolidation of the slurry layer into an optimum state at the time of unloading.

Thus, means for detecting the void ratio of slurry layer is advantageously provided. The detecting means preferred measures the level of the slurry precipitation surface for the reason described hereinafter.

If $H_o$ is the thickness of slurry layer at the beginning of precipitation and $e_o$ is the void ratio thereat, the equation with respect to the suitable thickness H of the slurry layer and the void ratio $e$ may be written as $$(H_o/1 + e_o) = (H/1 + e)$$

From this, the value $e$ may be obtained by measuring H, and therefore, the vacuum dewatering device may be stopped where the void ratio is not significantly lowered, but the vacuum dewatering device may be driven where the lowering of the void ratio proceeds. In this case, the height H of slurry may be obtained by the means 14 for detecting the precipitation surface level of a layer of the slurry as shown in FIG. 2, and the value $e$ may be further obtained from H.

From the foregoing description, it will be apparent that the present invention may provide the following effects.

Whereas, conventional slurry vessels are afflicted by marked consolidation of cargoes produced during the cruise to often extremely decrease the efficiency of unloading, the slurry vessel in accordance with the present invention comprises a vacuum tank connected to each of the dewatering ports arranged on a hold loading therein slurry-like cargoes through a pipe line, and a dewatering means including a vacuum pump connected to the upper portion of said vacuum tank through a pipe line and a drain pump connected to the lower portion of said vacuum tank through a pipe line, thereby alleviating the progress of consolidation of slurry cargoes and highly enhancing the efficiency in unloading.

In addition, the means for detecting the precipitation surface level of a layer of slurry has been arranged along with the above-described dewatering device so that the degree of consolidation of slurry layer may be suitably controlled.

It should now be apparent that the slurry vessel as described hereinabove, possesses each of the attributes set forth in the specification under the heading "Summary of the Invention" hereinbefore. Because the slurry vessel of the invention can be modified to some extent without departing from the principles of the invention as they have been outlined and explained in this specification, the present invention should be understood as encompassing all such modifications as are within the spirit and scope of the following claims.

What is claimed is:

1. A slurry vessel, including:

at least one arrangement of side walls and bottom wall together constituting wall means defining a hold for containing a layer of slurry comprising grains suspended in a liquid, which slurry is to be transported during a cruise of the vessel, during which cruise, the grains will be gradually precipitating, gradually producing an upper layer of supernatant liquid, and a lower layer of increased solids content slurry precipitant that is tending to increase in bulk density through consolidation, a gradually lowering interfacial surface forms and becomes better defined between said upper layer of liquid and said lower layer of slurry;

vacuum dewatering means comprising:

dewatering port means communicating with the hold through the wall means;

a vacuum tank connected to the dewatering port means and having a level up to which it is anticipated the vacuum tank may become filled with liquid;

a vacuum pump connected to the vacuum tank above said anticipated liquid level therein;

a drain pump connected to the vacuum tank for communication with the liquid drawn into the tank by the vacuum pump; and a drain line connected to the drain pump, for removing accumulating liquid from the vacuum tank;

means for detecting the level of the interfacial surface between the slurry contained in the hold and the supernatant liquid from which the slurry is precipitating, as a way of monitoring the degree of consolidation of the slurry, whereby the vacuum dewatering means may be operated when the degree of consolidation exceeds a predetermined value, to ensure that when the vessel reaches its destination, the slurry will not have consolidated to so great a degree as to hamper unloading, this level detecting means being constituted by a flat, essentially horizontally disposed plate having a plurality of generally vertical perforations which are adapted to allow free flow of supernatant liquid therethrough and means for suspending said plate, said plate being made of a material with specific gravity that is larger than that of the supernatant liquid of said slurry, but smaller than that of said slurry so that when lowered, via said suspending means, said plate will sink through any overlying supernatant liquid of said slurry and come to rest upon said slurry.

2. A process for controlling the degree of consolidation of a cargo of a slurry of grains suspended in liquid being transported in a hold of a water-borne vessel, which slurry has a tendency to precipitate with the passage of time, to produce an upper layer of supernatant liquid and a lower layer of slurry precipitant in which the bulk density is tending to increase due to consolidation, said process comprising:

sensing the degree of lowering of the interfacial surface between the slurry and the supernatant liquid from which the slurry is precipitating as a measure of the degree of consolidation of the slurry using a level detecting means that is constituted by a flat, essentially horizontally disposed plate having a plurality of generally vertical perforations which are adapted to allow free flow of supernatant liquid therethrough and means for suspending said plate, said plate being made of a material with specific gravity that is larger than that of the supernatant liquid of said slurry, but smaller than that of said slurry so that when lowered, via said suspending means, said plate will sink through any overlying supernatant liquid of said slurry and come to rest upon said slurry, and, when the degree of lowering exceeds a predetermined value, sucking liquid from the slurry by applying vacuum thereto from near the bottom of the hold, thereby increasing stress between solid particles of the slurry and limiting the mobility thereof.

* * * * *